US005722182A

United States Patent [19]

Lehtinen et al.

[11] Patent Number: 5,722,182

[45] Date of Patent: Mar. 3, 1998

[54] METHOD FOR DRYING A FIBRE WEB

[75] Inventors: Jukka Lehtinen; Jarmo Puumalainen, both of Tampere, Finland

[73] Assignee: Valmet Corporation, Helsinki, Finland

[21] Appl. No.: 783,068

[22] Filed: Jan. 15, 1997

[30] Foreign Application Priority Data

Apr. 12, 1996 [FI] Finland ..... 961640

[51] Int. Cl.[6] ..... F26B 5/04

[52] U.S. Cl. ..... 34/418; 34/355; 34/417; 34/242

[58] Field of Search ..... 34/306, 355, 398, 34/400, 428, 433, 434, 417, 95, 71, 242, 418

[56] References Cited

U.S. PATENT DOCUMENTS

| | | | |
|---|---|---|---|
| 4,043,157 | 8/1977 | Schiffer | 34/242 |
| 4,112,586 | 9/1978 | Lehtinen | 34/355 |
| 4,932,139 | 6/1990 | Lehtinen | 34/95 |
| 4,958,444 | 9/1990 | Rautakorpi et al. | 34/71 |
| 5,594,996 | 1/1997 | Haavisto | 34/66 |
| 5,594,997 | 1/1997 | Lehtinen | 34/95 |
| 5,604,995 | 2/1997 | Lehtinen | 34/417 |

*Primary Examiner*—Henry A. Bennett
*Assistant Examiner*—Pamela A. O'Connor
*Attorney, Agent, or Firm*—Ladas & Parry

[57] ABSTRACT

A method for drying a fibre web comprising passing the fibre web with at least one paper machine fabric between two bands which move in parallel. The bands have a good thermal conductivity and are impermeable to air. The fibre web and paper machine fabric are passed between the bands so that the fibre web is in contact with a first band to be heated and the paper machine fabric is in contact with a second band to be cooled. The method includes heating the first band with pressurized hot water, and cooling the band to be cooled with cooling water having substantially the same pressure and a lower temperature than the hot water.

12 Claims, 1 Drawing Sheet

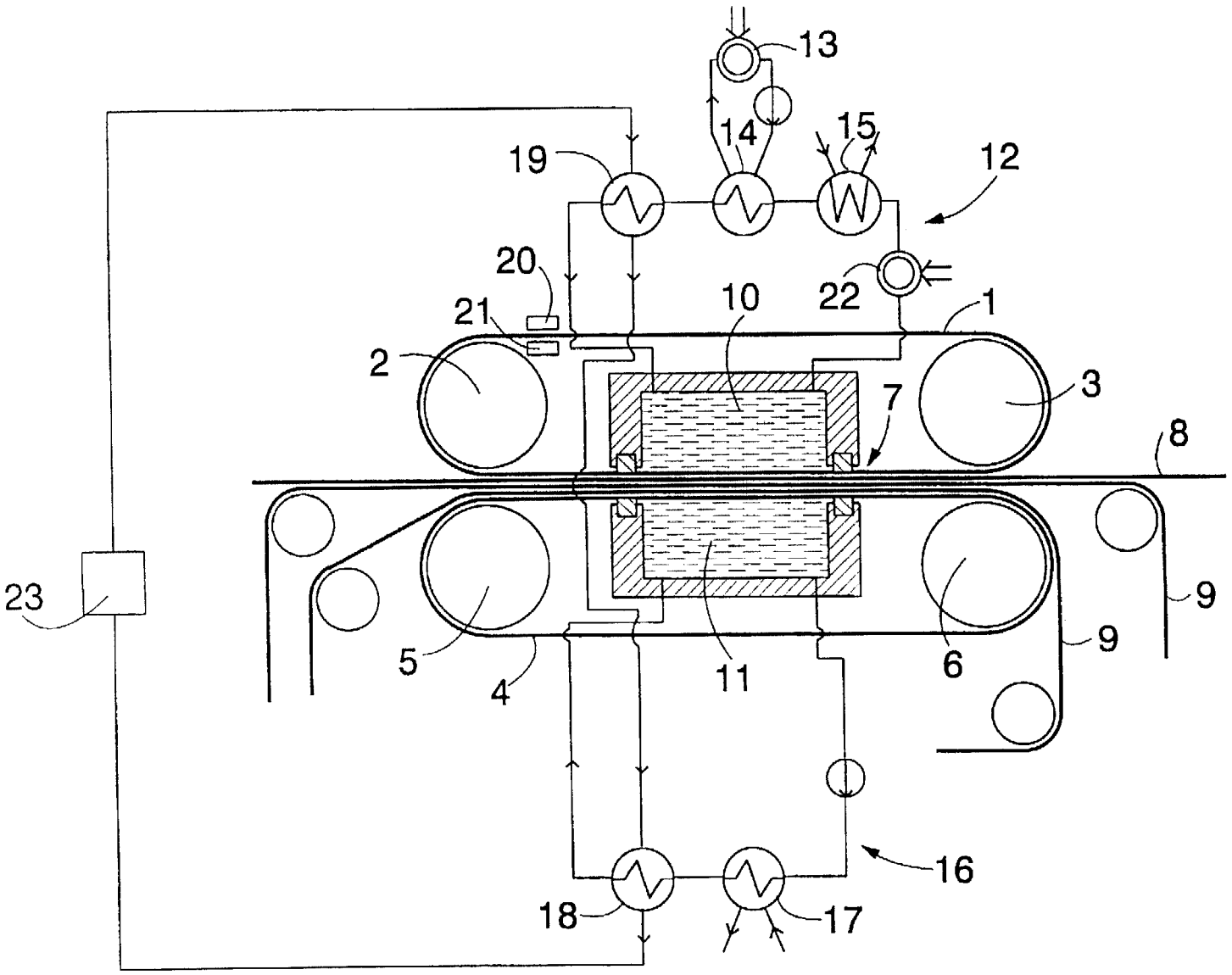
1
2
3
4
5
6
7
8
9
9
10
11
12
13
14
15
16
17
18
19
20
21
22
23

METHOD FOR DRYING A FIBRE WEB

FIELD INVENTION

The invention relates to a method for drying a fibre web, said method comprising passing a fibre web with at least one paper machine fabric to between two bands which move in parallel along part of their length, said bands having a good thermal conductivity and being impermeable to air, in such a manner that the fibre web is in contact with the first band and a paper machine fabric is in contact with the second band, whereby the bands form a drying zone between them when moving in parallel, and whereby the first band, which is in contact with the fibre web, is heated for evaporating the water in the fibre web, and correspondingly the second band, which is in contact with the paper machine fabric, is cooled with water to a temperature lower than that of the hot band for condensing the steam transferred from the fibre web to the paper machine fabric on the surface thereof.

BACKGROUND OF INVENTION

Drying a fibre web between two bands with a good thermal conductivity is based on heating the band which is in contact with the fibre web and which is impermeable to air. As a result of the heating, the water in the fibre web evaporates, and the steam passes through a paper machine fabric such as a felt or wire and is condensed on the surface of a cooled band or the wire or felt fabric in its vicinity. The condensate can be removed, for example, by doctor blades from the surface of the cooled band during the return cycle and by sucking it from the felt or wire by a suction box or the like. The known solutions disclosed in, for example, U.S. Pat. No. 4,461,095, FI 61537 and FI 78755 comprise heating the heated band with a high-temperature steam which is commonly available in paper mills; the cooled band is typically cooled with water the temperature of which is usually kept below 100° C.

The problem with the known solutions is that the temperature of the hot band is almost directly dependent on the steam pressure used, since a certain pressure results in a band temperature corresponding to the saturation temperature of the steam. When the steam pressure is increased, for example, the compression to which the web is subjected increases, but at the same time the drying temperature rises, too. This may be undesirable if the drying temperature is to be kept unchanged and only the compression is to be increased. Increasing the compression enhances the wet press strengths of the product, among other things. Pressurized steam chambers are also technically problematic in view of the seals, for example, and the removal of the condensate formed by steam on the hot belt also causes some problems.

SUMMARY OF INVENTION

The object of the present invention is to provide a method which allows the temperature of the hot band and the pressure values of the apparatus to be more easily and independently adjusted than before. The method of the invention is characterized in that the first band, which is against the fibre web, is heated with pressurized hot water in such a manner that the heating water and the cooling water have substantially the same pressure.

The method of the invention has the advantage that the use of water allows new combinations of compression and drying temperature to be achieved; the temperature and pressure are independent of each other provided that the pressure is higher than the saturation pressure corresponding to the temperature used. If this is the case, the water which is against the surface of the band to be heated does not evaporate. A further advantage is that the use of water and a high pressure allows the temperature of the hot water used for heating the band to be considerably higher than the currently employed temperatures: this renders it possible to reach heating temperatures of over 200° C. In addition, it also allows the use of lower temperatures than at present, but at the same time clearly higher pressures than at present, to provide desired properties for the fibre web. Yet another advantage is the possibility of using different heat supply alternatives. It is possible, for instance, to utilize the technology of conventional pressurized-water boilers for supplying heat to the pressurized water, whereby no separate steam production is needed. Pressurized water can also be heated simultaneously by several heat sources, for example by utilizing the heat recovery energy of the apparatus by means of a heat pump, and by generating any additional energy needed for instance by an oil burner or a natural gas burner. Naturally the water can also be heated simply by a steam heat exchanger.

BRIEF DESCRIPTION OF THE DRAWING

In the following, the invention will be described in greater detail with reference to the accompanying drawing, which is a schematic view of an apparatus for implementing the method of the invention.

DETAILED DESCRIPTION

The figure is a schematic view of a drying apparatus comprising a first band 1, which runs around first rolls 2 and 3. It further comprises a second band 4, which correspondingly runs around second rolls 5 and 6.

The first band 1 and the second band 4 run in parallel part of the way between rolls 2 and 3 and rolls 5 and 6, respectively, defining a drying zone 7 between them. The fibre web 8 and at least one paper machine fabric 9 pass between the bands 1 and 4 in such a way that the fibre web 8 comes in contact with the first band 1, and the paper machine fabric 9 comes in contact with the second band 4. There may be one or more paper machine fabrics, and they may be of a different type and structure, such as felts or wires, made of different materials.

A heating chamber 10 for heating the first band 1 is positioned against the first band 1, on the side of the band facing away from the fibre web 8, i.e. inside the loop formed by the band 1. Correspondingly, a cooling chamber 11 for cooling the second band 4 is positioned against the second band 4, on the side of the band facing away from the paper machine fabric 9, i.e. inside the loop formed by the second band 4. Water is supplied to both the heating chamber 10 and the cooling chamber 11 under substantially the same pressure in such a manner that the temperature of the heating water in the heating chamber 10 is over 100° C. and the temperature of the cooling water is lower than that of the heating water.

The water pressure may be, for example, 1 to 6 bar (abs) or higher; if high compression is desired, the pressure may be even more than 20 bar. The temperature of the heating water can also be adjusted in different ways; however, the temperature of the water must not exceed its evaporation temperature under the pressure prevailing in the chamber.

The water used for heating must be heated continuously, since part of the heat goes to drying the fibre web. The heating can be implemented, for example, by water circulation 12 such that water is circulated from the heating chamber 10 through a heat source. The heating water can be heated directly, for instance in a boiler 22 or the like where a suitable fuel is burnt, or it can be heated directly by electricity or some other heating medium. This can also take place in a separate unit 13 which is arranged to heat the heating water by means of a heat exchanger 14. Furthermore, the heating water can also be heated by supplying hot steam or flue gas through a heat exchanger 15. Cooling water must, in turn, be cooled, since condensation of steam heats it. The cooling water can be cooled, for example, by water circulation 16 cooled by a suitable technique. A simple embodiment employs a heat exchanger 17 through which cold water is circulated for cooling the cooling water to a desired temperature. The heat exchange can also be implemented by the use of a heat pump 23 which takes heat from the cooling water by means of a heat exchanger 18 and transfers it through a heat exchanger 19 to the heating water. The various heating and cooling methods can be implemented in different ways, depending on the circumstances, as long as the process conditions are suited for each particular use.

When a high pressure (e.g. 20 bar ) is used and the temperature difference between the bands is relatively small (e.g. the temperature of the heated first band is 150° C. and that of the cooled second band is 120° C., quite new quality properties can be achieved as compared with the prior art solutions. The figure also shows preheating chambers 20 and 21, which are positioned on both sides of the first band so that the first band is heated with water before it comes in contact with the fibre web in the drying zone. Very high temperatures and pressures can be employed in the preheating chambers 20 and 21: the temperature may be 200° C. to 250° C. and the pressure may be even 50 bar or more. However, it would be impossible in practice to use such steam pressures in preheating chambers in order to obtain a high temperature, because of sealing problems and the availability of steam, for example. The use of a high temperature allows a great amount of heat to be stored in the first band, which essentially expedites and enhances the drying process; the other process parameters can then be selected more freely according to the desired quality properties of the fibre web.

In the specification above and in the drawing, the invention has been described merely by way of example and it is by no means restricted to this example. The pressure values and temperatures of water can be selected quite freely provided that the temperature and pressure of the heating water are such that the temperature of the water does not exceed the saturation temperature of the water under the prevailing pressure. The method for heating the water to be heated, the method for cooling the water to be cooled, and the technical solutions can be freely selected according to the conditions.

We claim:

1. In a method for drying a fibre web, said method comprising passing a fibre web with at least one paper machine fabric between first and second bands which move in parallel along part of their length, said bands having a good thermal conductivity and being impermeable to air, such that the fibre web is in contact with the first band and the at least one paper machine fabric is in contact with the second band, whereby the bands form a drying zone between them when moving in parallel, the first band, which is in contact with the fibre web, being heated to a temperature for evaporating the water in the fibre web, and the second band, which is in contact with the at least one paper machine fabric, being cooled to a temperature lower than the temperature of the first band for condensing steam transferred from the fibre web to the at least one paper machine fabric, the improvement comprising heating the first band with heating water at a pressure, the heating water being at a temperature that does not exceed an evaporation temperature of the heating water at said pressure, said second band being cooled with cooling water that is at substantially the same pressure as the pressure of the heating water.

2. A method according to claim 1, wherein the pressure of the heating and cooling water is set at least 6 bar.

3. A method according to claim 2, wherein the pressure of the heating and cooling water is set at least 20 bar.

4. A method according to claim 1, wherein the temperature of the cooling water is kept higher than 100° C.

5. A method according to claim 1, wherein the temperature of the heating water is kept higher than 150° C.

6. A method according to claim 1, wherein the heating water is heated by transferring heat by means of a heat pump from the cooling water to the heating water.

7. A method according to claim 1, wherein the heating water is heated simultaneously by at least two different heat sources.

8. A method according to claim 1, wherein the first band to be heated is preheated before the drying zone on both sides with high-pressure hot water.

9. A method according to claim 8, wherein the temperature of the water used for preheating is at least 120° C., and the pressure is in the range of 3 to 50 bar.

10. A method according to claim 9, wherein the temperature of the water used for preheating is between 180° C. to 250 ° C.

11. A method according to claim 1 further comprising adjusting the temperature of the heating water to a different temperature without changing the pressure of the heating water.

12. A method according to claim 1 further comprising raising the pressure of the heating water and the pressure of the cooling water without raising the temperature of the heating water.

* * * * *